United States Patent [19]

Cox, Jr.

[11] 4,020,229

[45] Apr. 26, 1977

[54] MULTI-CAVITY FILAMENTS

[75] Inventor: Paul R. Cox, Jr., Cary, N.C.

[73] Assignee: Hercules Incorporated, Wilmington, Del.

[22] Filed: Aug. 7, 1975

[21] Appl. No.: 602,953

[52] U.S. Cl. ..... 428/372; 428/398

[51] Int. Cl.[2] ..... D02G 3/00

[58] Field of Search ..... 428/397, 398, 373, 374, 428/372; 264/171

[56] References Cited

UNITED STATES PATENTS

| | | | |
|---|---|---|---|
| 3,562,374 | 2/1971 | Okamoto et al. | 264/128 |
| 3,745,061 | 7/1973 | Champaneria et al. | 428/398 |

*Primary Examiner*—Lorraine T. Kendell
*Attorney, Agent, or Firm*—Stanley A. Becker

[57] ABSTRACT

Multi-cavity filaments having improved resilience and anti-soiling properties have continuous cavities along their length with each cavity having a vertex angle formed by two sides or legs of the cavity of between about 65° and 140°. The vertex angle of each cavity points substantially toward the center axis of the filament. The cavities are spaced from each other and from the periphery of the filament in a manner producing a filament having good physical and aesthetic properties.

5 Claims, 6 Drawing Figures

MULTI-CAVITY FILAMENTS

BACKGROUND OF THE INVENTION

This invention relates to a novel textile filament having improved properties including soil resistance, resilience, torsional recovery, static dissipation, bulk, dielectric and acoustical qualities and luminosity combined with a high luster. More specifically, it relates to a filament containing a plurality of continuous internal cavities of predetermined size, shape, position and orientation to provide a filament with the aforesaid properties and characteristics.

The characteristic and highly desirable luster or light reflective properties of conventional solid synthetic filaments having a round cross-sectional shape is considerably dulled by the incorporation of pigmentary coloring matter. In order to restore some of this luster, it has previously been proposed to form synthetic filaments in non-round cross-sectional shape, such as described, for example, in U.S. Pat. Nos. 2,939,201, 3,425,893, 3,499,958 and 3,508,390. A number of non-round cross-sectional shapes have been utilized, including, for example, triangular cruciform, H-shaped, Y-shaped and trilobal. In general, these cross-sectional shapes exhibit a high degree of light reflectance which results in the appearance of luster. In addition to providing luster, the light reflectance of the non-round cross-sectional shape of the filaments visually masks the presence of soil on the surface of the filament. However, with most of the desirable cross-sections, there are concavities or crevices on the surface in which soil, detergents and other foreign matter become trapped and cannot readily be removed by normal cleaning. As soil accumulates in these cavities, the light reflectance is gradually destroyed, and both the luster and the soil hiding characteristics of the filaments are lost.

It has been proposed to overcome the soiling problem by providing internal cavities within the filament. U.S. Pat. No. 3,745,061 teaches the preparation of such a filament. However, this reference teaches that where a bright filament luster is desired, the filaments should have flattened sides and rounded corners. Additionally, for maximum luster, the reference discloses that the filaments should contain less than 0.5% of an opaque pigment.

It has also been proposed to make filaments having cavities therein as disclosed, for example, in U.S. Pat. Nos. 2,965,925, 3,493,459, 3,558,420 and 3,745,061. One problem with such filaments is that as the cavity volume increases the bending stiffness and torsional rigidity decreases, thereby adversely affecting the resilience of the filament.

SUMMARY OF THE INVENTION

The subject invention relates to filaments having continuous cavities therein of a certain shape, size, orientation and position to provide filaments having a high degree of luster even at high pigment concentrations and having good soil resistant and resilient properties and having relatively high cavity volumes without substantial loss of bending stiffness or torsional rigidity. The internal structure of the filament is designed to give high light reflection and complex light refraction while maintaining an essentially smooth, round periphery that resists soiling and enhances cleanability. The hollow filaments may have from three to six cavities which extend continuously through the length of these filaments and are substantially parallel to one another. The cavities are preferably of substantially equal cross section and each cavity is formed to have an angle at the vertex nearest the center of the filament, hereinafter referred to as the "vertex angle", of between about 65° and 140°. The vertex angle of each cavity is pointed substantially toward the center of the filament. The outer extremity of the cavity is displaced from the periphery of the filament by a distance T equal to at least about one-tenth of the radius R of the filament. The adjacent cavities are spaced apart by a distance W as measured at the outer extremities of the cavities, with W being equal to or greater than two-tenths of the radius of the filament.

The cavities can be either quadrilateral as, for example, diamond-shaped, or they can be sector-shaped. Normally, although not necessarily, the sector shape is employed where the cavities are three in number and the diamond shape is used with more than three cavities. The internal structure that results from the multiple cavities within the interior of these filaments causes a high degree of light reflection internally of the filament along with complex refraction patterns which result in a high luster. At the same time, the essentially round, smooth outer surface of the filament enhances cleanability thereof so that the luster does not become dulled by entrapment of soil, detergents and other foreign matter.

Other advantages of the present invention will be apparent from the following detailed description of the invention when considered in conjunction with the following detailed drawings. It is to be noted that the drawings illustrate only typical embodiments of the invention and are therefore not to be considered limiting of its scope, for the invention may admit to other equally effective embodiments.

DESCRIPTION OF THE INVENTION

Figure 1:
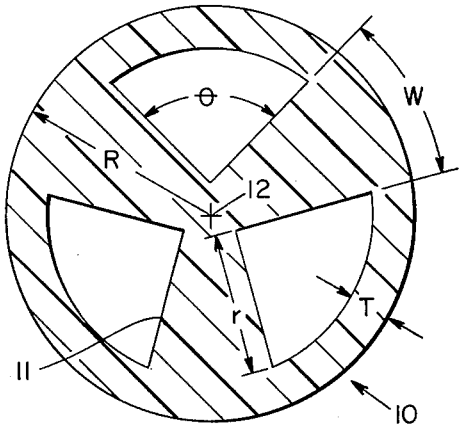
FIGS. 1–4 respectively illustrate cross-sections of typical three, four, five and six cavity filaments in accordance with the principles of this invention.

Referring to FIG. 1, there is shown a filament 10 having three cavities 11 formed therein. The cavities are of substantially equal size and equal spacing from one another. The vertex angle of each cavity indicated as theta ($\theta$) is critical and cannot be greater for a three-cavity filament than about 140°. The vertex angle $\theta$ is oriented toward the central axis 12 of the filament 10. The radius of the filament is designated as R. The dimension W is the effective width between the outer points of adjacent cavity legs which are designated as *r*. The dimension T designates the thickness which is the distance from the outermost point of the cavity 11 to the periphery of the filament. In a typical cross-sectional configuration, the dimension W should be equal to or greater than 0.2 R. T must also be sufficiently wide to maintain the desired amount of fiber stability and rigidity during processing and end use. The thickness T will vary with molecular weight and melt flow index of the polymer but generally this dimension should be greater than 0.1 R.

Figure 2:
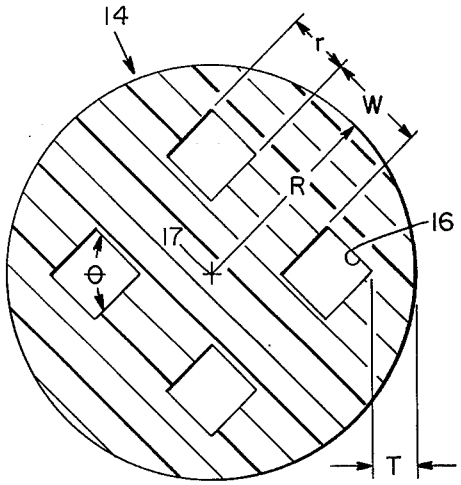

Referring to FIG. 2, there is shown a four-cavity filament 14 having four diamond-shaped cavities 16 therein equidistantly spaced from one another and each having their vertex angles $\theta$ pointing toward the central axis 17 of the filament. The structure of the filament is such that the angle $\theta$ is no greater than 110°, the dimension T is greater than 0.1 R and W is equal to or greter than 0.2 R.

Figure 3:
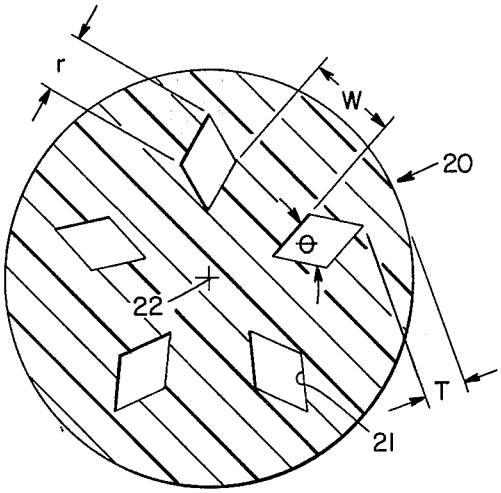

Referring to FIG. 3, there is shown a hollow filament 20 having five diamond-shaped cavities 21 formed therein, each having their vertex angles $\theta$ pointing toward the central axis 22. As indicated above, the thickness T is greater than 0.1 R and the width W is equal to or greater than 0.2 R to produce the desired qualities and characteristics of the filament as enumerated above. The maximum vertex angle $\theta$ permitted with a five-cavity filament is about 90°. When the angle becomes greater than 90°, then the width and thickness dimensions decrease below the minimum required for optimum characteristics of the filament.

Figure 4:
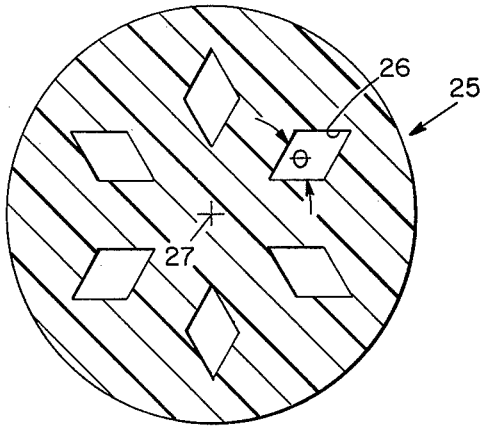

Referring to FIG. 4, there is shown another filament 25 having six diamond-shaped cavities 26 formed therein, each having a vertex angle $\theta$ which is no greater than about 70°. The vertex angle is positioned to point toward the central axis 27 of the filament 25.

It is essential that the limitations with respect to the size and the orientation of the vertex angle be met. If the vertex angle is not pointed substantially toward the central axis of the filament, the lustrous appearance which is desired in these filaments is not realized. This failure to achieve high luster is believed to be due to the failure to achieve the required reflection and refraction patterns from which luster results. The same is true if the vertex angle is less than about 65° or greater than about 140°, depending upon the number of cavities in each filament.

Because of the internal structure of the hollow filaments which results when cavities are produced, unusual resilience, torsional recovery and bending recovery are realized. The static dissipation also is considerably improved over solid, round filaments and profiled filaments having varied cross-sectional shapes, such as T or Y-shaped. The internal structural segments surrounding the cavities also greatly increase the maximum obtainable cavity volume within the filament, thus the bulk, covering power and related properties are extraordinarily good.

With respect to luster, a very high luster is obtained even when the polymer contains a high loading of a normally translucent or opaque pigment. Thus the pigment loading can be up to about 25% without substantially destroying luster. Any of the commonly used pigments can be utilized. The invention is particularly suited to polypropylene filaments since with other filament-forming polymers it is sometimes difficult to meet the specified limitations which result in the unique properties and characteristics exhibited by the filaments of this invention. In particular, it may be difficult to prepare sector or diamond-shaped cavities with other materials, since the lower melt viscosity of most other polymers allows the vertex angle to achieve a round configuration which generally provides a vertex angle greater than that specified therein.

Figure 5:
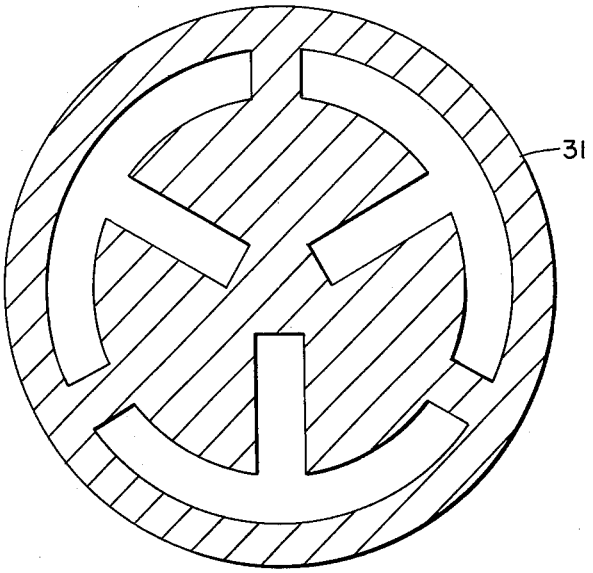
FIGS. 5 and 6 illustrate typical spinneret orifice designs utilized in making the multi-cavity filaments shown in FIGS. 1 and 2 respectively.
Figure 6:
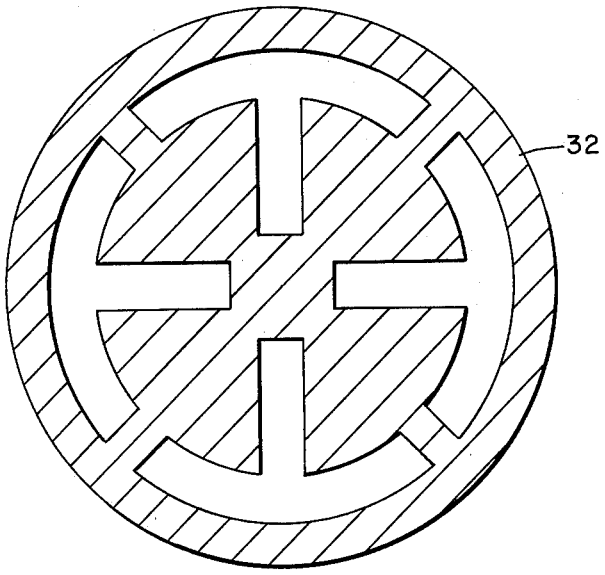

Referring to FIGS. 5 and 6, there is shown typical spinneret cross-sections 31 and 32 employed in preparing three and four-cavity filaments of this invention. The filaments of this invention are prepared by melt spinning using conventional techniques with the slotted or segmented orifice spinnerets of the types shown in FIGS. 5 and 6. It is necessary to use a combination of polymer melt temperature and quenching rates for the jet swell and melt flow to be coordinated to allow essentially all of the segments of molten polymer to properly unite to produce the continuous structure as illustrated in FIGS. 1 to 4. It is particularly important that process conditions are selected so that all segments of the filament can fuse into a continuous structure while maintaining the required critical vertex angle of each cavity. This involves coordination of polymer melt temperature and quench rate with the intrinsic viscosity of the polymer so that the polymer jet swell and melt flow rate are correct to accomplish the uniting and fusion.

It has been found that the quench rate is particularly important in maintaining the shape of the critical vertex angle. The rate of quenching the polymer melt in spinning multi-cavity filaments is critical to maintain the cavity shape and yet properly fuse the segments of the filaments so that the resulting filament has the desirable physical properties and aesthetics. Quench rate, however, can depend on a number of variables such as velocity and volume of quench air, rate the polymer melt extrudes through the spinneret slots per given time, width of the slots in the spinneret, polymer melt flow rate, intrinsic viscosity of the polymer, position that the spinneret slot is oriented in relation to the quench air or gas direction, polymer melting point, melt temperature, quench air temperature, rate of draw down of the polymer melt from the spinneret hole and the quantity of additives, such as pigments and stabilizers, incorporated in the melt. Since the proper quantity and velocity of quench air necessary to produce multicavity filaments can be varied by changing one or more of the conditions mentioned above, a single condition or filament property is needed to characterize a good operating state. It has been found that such an operating state can be readily determined by examining a sample of the multicavity filament for spherulites using a microscope. Large spherulites on the surface or any place internally within the filament decrease the luster, drawability, modulus and toughness of the filament. All of these are serious defects to the physical properties and aesthetics of the filament. Consequently, by regulating the quenching rate so that the spherulite size visible under magnification is 8 microns or smaller in diameter, and preferably less than 1 micron, the resulting filaments will possess the desired physical properties and aesthetics.

The invention is illustrated by the following examples:

EXAMPLE 1

Using a spinneret having the orifice design shown in FIG. 6 hollow filaments having four equally spaced diamond-shaped cavities were spun from a heat and light stabilized polypropylene containing 0.34% of a chromophthal yellow pigment. A twelve-orifice spinneret was employed using a melt temperature of 265°C. and a spin rate of 650 meters per minute. The filaments were slowly quenched by applying an exhaust air suction of 132 feet/minute near the spinneret face and cross blowing air at 50 feet/minute in the spin chimney. The suction also removed any gaseous products which were emitted from the spinneret. The filament bundle then was drawn to 15 denier per filament using draw and feed rolls heated to 105° C.

Each of the filaments produced was substantially round and contained four symmetrically spaced diamond-shaped cavities which were essentially parallel throughout the length of the filament. The vertex angle of each was about 65° and each vertex angle was pointed directly at the center axis of the filament. Total cavity area in each filament was about 20%. Compared with a solid round filament of the same polymer spun under the same conditions, having the same denier, the hollow fibers were more lustrous, more translucent, and more aesthetically appealing.

EXAMPLE 2

The same conditions and the same spinning equipment as in Example 1 were employed except that the melt pumping rate was reduced to reduce the denier of the drawn filaments to 3.75 dpf. This yarn and a similar yarn of solid, round configuration were knitted into 4 inch diameter tubing. The tubing from the four-cavity hollow fiber had better coverage, a highly lustrous appearance, a lighter hue, better color clarity and a generally more appealing aesthetic appearance than that made from the solid filament yarn.

EXAMPLE 3

A heat and light stabilized chromophthal yellow pigment polypropylene (0.34% pigment) formulation was spun using a melt temperature of 265° C. Twelve-hole spinnerets of different cross-section designs were used to produce filaments of the same undrawn denier (56 denier/fil.). The filaments had the following cross-section configurations:

| Spinning Position | Filament Cross-Section Shape |
|---|---|
| 1 | 4-cavity round |
| 2 | Solid round |
| 3 | Solid "T" or "Y" |

The filaments were quenched using 132 ft./min. of exhaust air and 50 ft./min. cross-below air as in Example 1.

The cross-sections of the four-cavity hollow round filaments were examined microscopically before drawing. A typical filament contained four diamond-shaped cavities which were substantially the same size and symmetrically spaced around the center of the filament. The angle of the cavity pointed toward the center of the fiber and had a vertex angle of about 67°. Other pertinent dimensions of the filament were as follows:

W — $11 \times 10^{-4}$ inches
R — $29.6 \times 10^{-4}$ inches
r — $7.9 \times 10^{-4}$ inches
T — $4.9 \times 10^{-4}$ inches The area of the four-cavity hollow filament cross-section was 35% greater than the control solid round filament cross-section.

Eight filament bundles from Position 1 were plied using a ¼ turn/inch (tpi) Z twist. This plied yarn was drawn 2.67X at a 717 meters/min. draw speed using a feed and a draw roll which were each heated to 105° C. This plying and drawing procedure was repeated using yarns from Positions 2 and 3.

Each of the three drawn yarns was crimped using a steam texturing process according to standard conditions developed for commercial "T" cross-section polypropylene carpet yarns. These crimping conditions were optimum for the other filaments, but probably were less than optimum for the other filaments. Nevertheless, the four-cavity hollow filament yarn (Position 1) developed more bulk, bulked more readily and had a firmer hand than either of the others. The solid round cross-section filament bulked poorer than the T filament.

The bulked four-cavity hollow yarn and the solid round yarn were tufted into sculptured (high-low pile) carpets having 18 oz./sq. yard face weight, 7 stitches per inch, 5/32 gauge (inches) and ⅝ inch thickness (unfinished) using a nonwoven polypropylene primary backing material. The unfinished carpets were then scoured, latexed and finished with a jute secondary backing according to established procedures.

The carpets were evaluated by specialists in this field. The four-cavity hollow and filament carpet (test carpet) was compared to the carpet made with the solid round filament (control carpet). The test carpet was superior to the control carpet in luster, coverage, hand and general overall appearance. Each carpet was then evaluated in a 6000 step floor performance test. The test carpet was judged superior to the control carpet in anti-soiling characteristics, cleanability, pattern retention and overall appearance.

What I claim and desire to protect by Letters Patent is:

1. A polypropylene filament having a substantially round cross-section, the cross-section at any point along the length of the filament having three or more cavities of substantially equal cross-section therein, each of said cavities having two legs forming a vertex angle therebetween of between about 65° and 140°, with said vertex angle being pointed substantially directly toward the center axis of the filament.

2. A polypropylene filament as set forth in claim 1 wherein said cavities are spaced from the periphery of the filament by a distance no less than one-tenth the radius of the filament and the distance between adjacent cavities at the outer points of said legs being no less than two-tenths the radius of the filament.

3. A polypropylene filament as set forth in claim 1 wherein said filament has spherulites of 8 microns or smaller in diameter.

4. A polypropylene filament as set forth in claim 2 wherein said cavities are quadrilateral in shape.

5. A polypropylene filament as set forth in claim 2 wherein said cavities are sector shaped.

* * * * *

UNITED STATES PATENT OFFICE

CERTIFICATE OF CORRECTION

Patent No. 4,020,229 Dated April 26, 1977

Inventor(s) Paul R. Cox, Jr.

It is certified that error appears in the above-identified patent and that said Letters Patent are hereby corrected as shown below:

Column 3, line 8, "greter" should read -- greater --.

Column 3, line 63, "therein" should read -- herein --.

Column 6, line 11, "were optimum for the other filaments, but probably" should read -- were optimum for "T" filaments, but probably --.

Column 6, line 27, --round-- should be inserted after "hollow".

Signed and Sealed this fifth Day of July 1977

[SEAL]

Attest:

RUTH C. MASON
*Attesting Officer*

C. MARSHALL DANN
*Commissioner of Patents and Trademarks*